US005927070A

United States Patent [19]

Northam et al.

[11] Patent Number: 5,927,070

[45] Date of Patent: Jul. 27, 1999

[54] LIGHTWEIGHT EXHAUST MANIFOLD AND EXHAUST PIPE DUCTING FOR INTERNAL COMBUSTION ENGINES

[75] Inventors: G. Burton Northam, Carrollton; Philip O. Ransone, Gloucester; H. Kevin Rivers, Hampton, all of Va.

[73] Assignee: The United States of America as represented by the Administrator of the National Aeronautics and Space Administration, Washington, D.C.

[21] Appl. No.: 08/816,404

[22] Filed: Mar. 5, 1997

Related U.S. Application Data

[60] Provisional application No. 60/012,939, Mar. 6, 1996.

[51] Int. Cl.[6] ..... F01N 3/00

[52] U.S. Cl. ..... 60/282; 60/323

[58] Field of Search ..... 60/323, 282; 164/35, 164/98

[56] References Cited

U.S. PATENT DOCUMENTS

| | | | |
|---|---|---|---|
| 4,683,809 | 8/1987 | Taylor . | |
| 4,736,676 | 4/1988 | Taylor . | |
| 4,884,400 | 12/1989 | Tanaka et al. | 60/323 |
| 4,894,286 | 1/1990 | Gray | 428/408 |
| 4,909,133 | 3/1990 | Taylor . | |
| 5,018,661 | 5/1991 | Cyb | 60/323 |
| 5,052,463 | 10/1991 | Lechner et al. | 164/35 |
| 5,083,537 | 1/1992 | Onofrio et al. . | |
| 5,370,087 | 12/1994 | Guimond et al. . | |
| 5,687,787 | 11/1997 | Atmur et al. | 164/98 |

*Primary Examiner*—Thomas E. Denion
*Attorney, Agent, or Firm*—Kurt G. Hammerle

[57] ABSTRACT

An improved exhaust system for an internal combustion gasoline-and/or diesel-fueled engine includes an engine exhaust manifold which has been fabricated from carbon-carbon composite materials in operative association with an exhaust pipe ducting which has been fabricated from carbon-carbon composite materials. When compared to conventional steel, cast iron, or ceramic-lined iron parts, the use of carbon-carbon composite exhaust-gas manifolds and exhaust pipe ducting reduces the overall weight of the engine, which allows for improved acceleration and fuel efficiency; permits operation at higher temperatures without a loss of strength; reduces the "through-the wall" heat loss, which increases engine cycle and turbocharger efficiency and ensures faster "light-off" of catalytic converters; and, with an optional thermal reactor, reduces emission of major pollutants, i.e. hydrocarbons and carbon monoxide.

16 Claims, 3 Drawing Sheets

LIGHTWEIGHT EXHAUST MANIFOLD AND EXHAUST PIPE DUCTING FOR INTERNAL COMBUSTION ENGINES

CLAIM OF BENEFIT OF PROVISIONAL APPLICATION

Pursuant to 35 U.S.C. §119, the benefit of priority from provisional application 60/012,939, with a filing date of Mar. 6, 1996 is claimed for this non-provisional application.

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

1. Field of the Invention

This invention relates to a lightweight exhaust-gas manifold and exhaust-gas pipe ducting for internal combustion gasoline- and diesel-fueled engines, and more specifically to improved structures for an exhaust-gas manifold and exhaust-gas pipe ducting which are fabricated from carbon-carbon composite materials.

2. Description of the Related Art

Conventional internal combustion gasoline- and diesel-fueled engines employ exhaust-gas manifolds and ducting fabricated from cast iron, steel, or iron with ceramic liners. These manifolds are well known to the art to be heavy and thermally conductive, and to lose strength at elevated engine operating temperatures, i.e., above 600 degrees Fahrenheit. The weight of an exhaust-gas manifold adds considerably to the total engine weight of an aluminum block automobile engine. Hence, reducing the weight of an exhaust-gas manifold and ducting would have a dramatic effect on total engine weight. On the other hand, in large industrial diesel engine applications, in which the weight of an exhaust-gas manifold and ducting is minimal with respect to the total engine weight, the excess weight is less of a concern.

The high thermal conductivity and high specific heat of cast-iron and steel exhaust manifolds and exhaust ducting result in considerable "through-the-wall" heat loss into the environment. While automobile engine manufacturers often utilize this heat loss to preheat air for cold-starting purposes, for the most part, "through-the-wall" heat loss reduces engine operating efficiency. In internal combustion engines equipped with a turbocharger, heat loss between the exhaust valves and the turbocharger reduces the energy level of the working gas driving the turbocharger compressor, which results in reduced performance of the turbocharger. In internal combustion engines with a catalytic converter, electric heaters, or burners, must be installed upstream of the converter to compensate for the heat loss, to ensure "light-off" of the converter during the warm-up phase of engine operation.

SUMMARY OF THE INVENTION

Accordingly, an object of this invention is to reduce the weight of an internal combustion engine.

It is another object of the present invention to provide an engine with improved acceleration and fuel efficiency, due to reduced exhaust-gas manifold and exhaust pipe ducting mass.

It is still another object of the present invention to provide an engine which improves engine-cycle and/or turbocharger operating efficiency by reducing "through-the-wall" heat loss.

It is a further object of the invention to provide an engine which ensures faster "light-off" in the catalytic converter.

It is yet another object of the invention to provide an engine which reduces the emission of hydrocarbons and carbon monoxide by additionally including a thermal reactor.

According to the present invention, the foregoing and additional objects are attained by fabricating gasoline- and diesel-fueled engine exhaust-gas manifolds and exhaust pipe ducting from molded, woven, laid up, or chopped fiber carbon-carbon composite materials, including any additives and/or fillers, to afford low "through-the-wall" heat loss.

Carbon-carbon composite materials, as used herein, refer to a predominantly carbon matrix material reinforced with predominantly carbon fibers, and are well known to the art. The properties of these materials may be tailored to produce any desired mechanical and physical properties by preferred orientation of the continuous or staple fibers in the composite materials; and/or by the selection of additives; and/or by thermal treatment of the fibers and matrix before, during, or after fabrication. Carbon-carbon composite materials may be cast, molded, or laid up, and are machineable. The surface or near-surface material can also be treated and/or coated with oxidation protection or sealing materials.

Carbon-carbon composite materials were developed for high temperature and high strength aerospace applications. Carbon-carbon composites are inherently lightweight; maintain their strength at elevated temperatures (i.e. up to 2500 degrees F.): and can be manufactured with low coefficients of thermal expansion, low specific heat, and low thermal conductivity. Current aerospace application of carbon-carbon composite materials includes use as heat-shield material on advanced aerospace vehicles.

Gasoline- and diesel-fueled engines equipped with exhaust-gas manifolds and exhaust pipe ducting fabricated from carbon-carbon-composite materials benefit from reduced engine weight, which improves fuel efficiency and overall vehicle performance; and from reduced "through-the-wall" heat loss, which ensures faster "light-off" of the catalytic converter and improves turbocharger and overall engine operating efficiency.

Inclusion of a thermal reactor in the exhaust-gas manifold replaces the need for a catalytic converter. In operation, a thermal reactor mixes ambient air with fuel-rich exhaust gases in a mixer. The mixer consists of a plurality of baffle plates, which confine these exhaust gases, mix them with ambient air, expose them to high temperatures, and finally convert hydrocarbons and carbon monoxide into carbon dioxide and water.

DETAILED DESCRIPTION OF THE INVENTION

Figure 1:
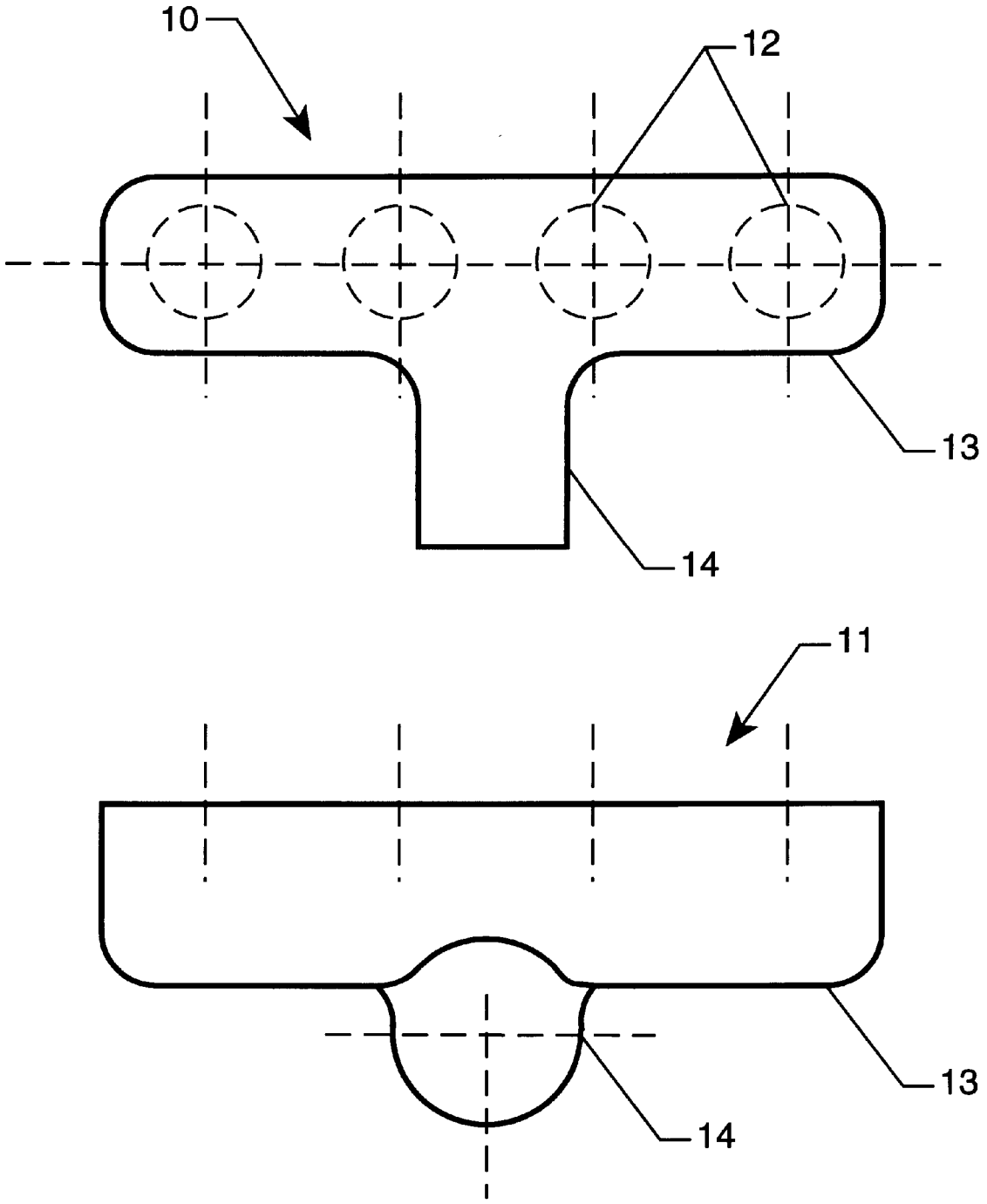
FIG. 1 is an illustration of a prior art engine employing an exhaust gas manifold and exhaust pipe ducting fabricated from steel, cast iron, or iron with a ceramic liner.

The invention is an improvement in the structure of a gasoline-and/or diesel-fueled engine with the improvement achieved by fabricating exhaust-gas manifold and exhaust pipe ducting from lightweight carbon-carbon composite materials. FIG. 1 depicts a conventional cast iron, steel, and/or ceramic-lined iron engine exhaust system in side 10 and plan view 11. The exhaust system consists of a plurality of engine exhaust ports 12 (four shown herein) which connect to the engine exhaust-gas manifold 13 for the purpose of expelling exhaust gases through a single, common exhaust pipe 14. To relieve back pressure on the exhaust valves (not shown), the interior surfaces of the exhaust-gas manifold 13 and exhaust pipe 14 are contoured.

Figure 2:
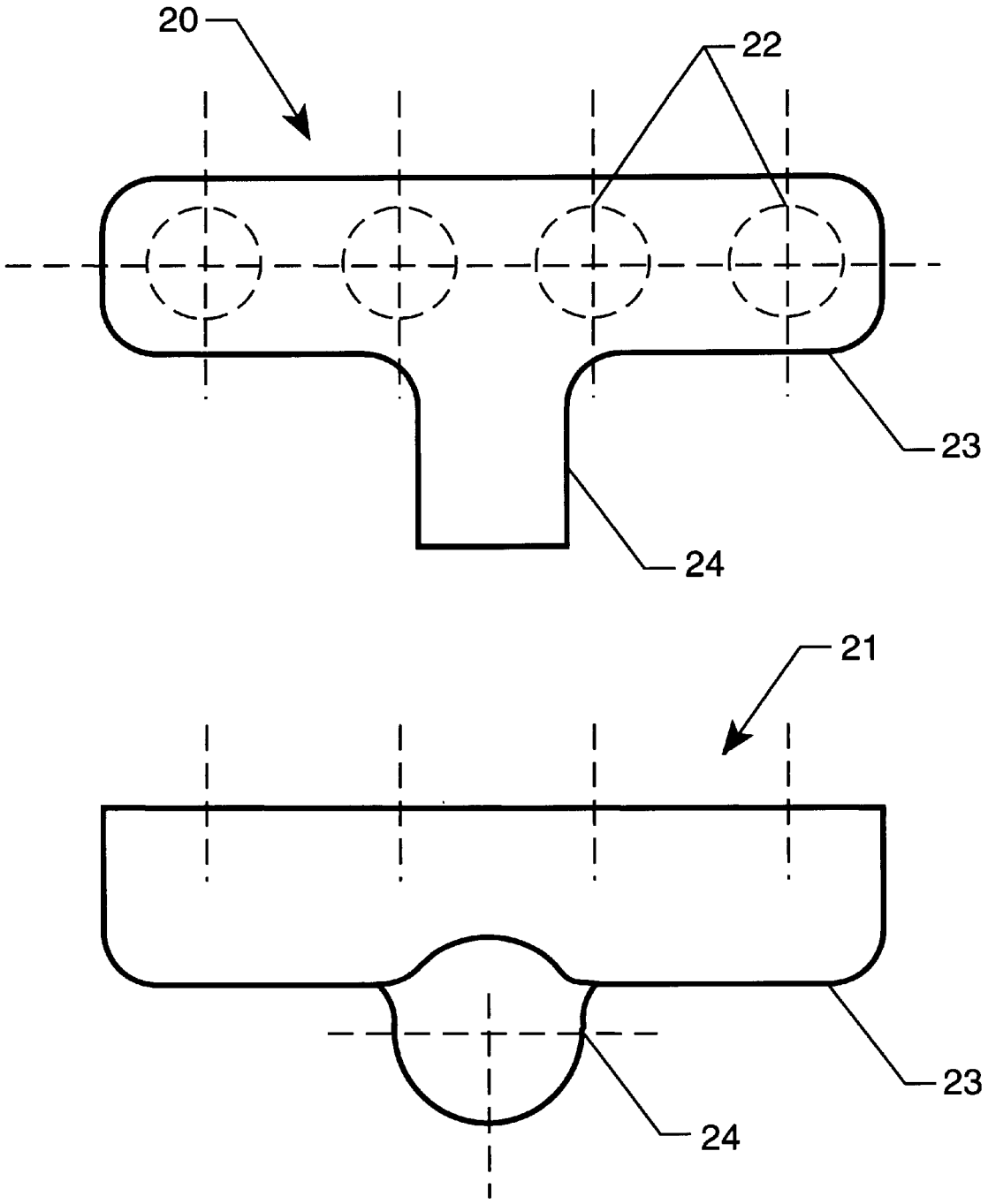
FIG. 2 is an illustration of an engine with its exhaust-gas manifold and exhaust pipe ducting fabricated from carbon-carbon composite materials according to the present invention.

FIG. 2 depicts a side 20 and plan view 21 of an improvement to an engine exhaust system according to the present invention with the exhaust-gas manifold 23 and exhaust pipe 24 fabricated from carbon-carbon-composite materials. Carbon-carbon composite materials used for the exhaust-gas manifold 23 and exhaust pipe 24 are constructed from molded, woven, or chopped fiber carbon-carbon materials, including any additives or fillers, to yield low "through-the-wall" heat loss. The operation of the engine exhaust system is not altered in any way by using carbon-carbon composite materials, as a plurality of exhaust ports 22 connect to a single, common exhaust pipe 24 through an exhaust-gas manifold 23.

As with the prior art, the interior surfaces of the exhaust-gas manifold 23 and exhaust pipe 24 are contoured to relieve pressure on the exhaust valves. To provide protection from oxidation and excessive wear, the interior surfaces of the exhaust-gas manifold 23 and the exhaust pipe 24 are treated with a ceramic or metallic coating.

To reduce heat loss further, any turbocharger (not shown) and/or catalytic converter (not shown) are located as close to the exhaust manifold 23 as possible, in order to reduce heat loss and "light-off" time, respectively.

Figure 3:
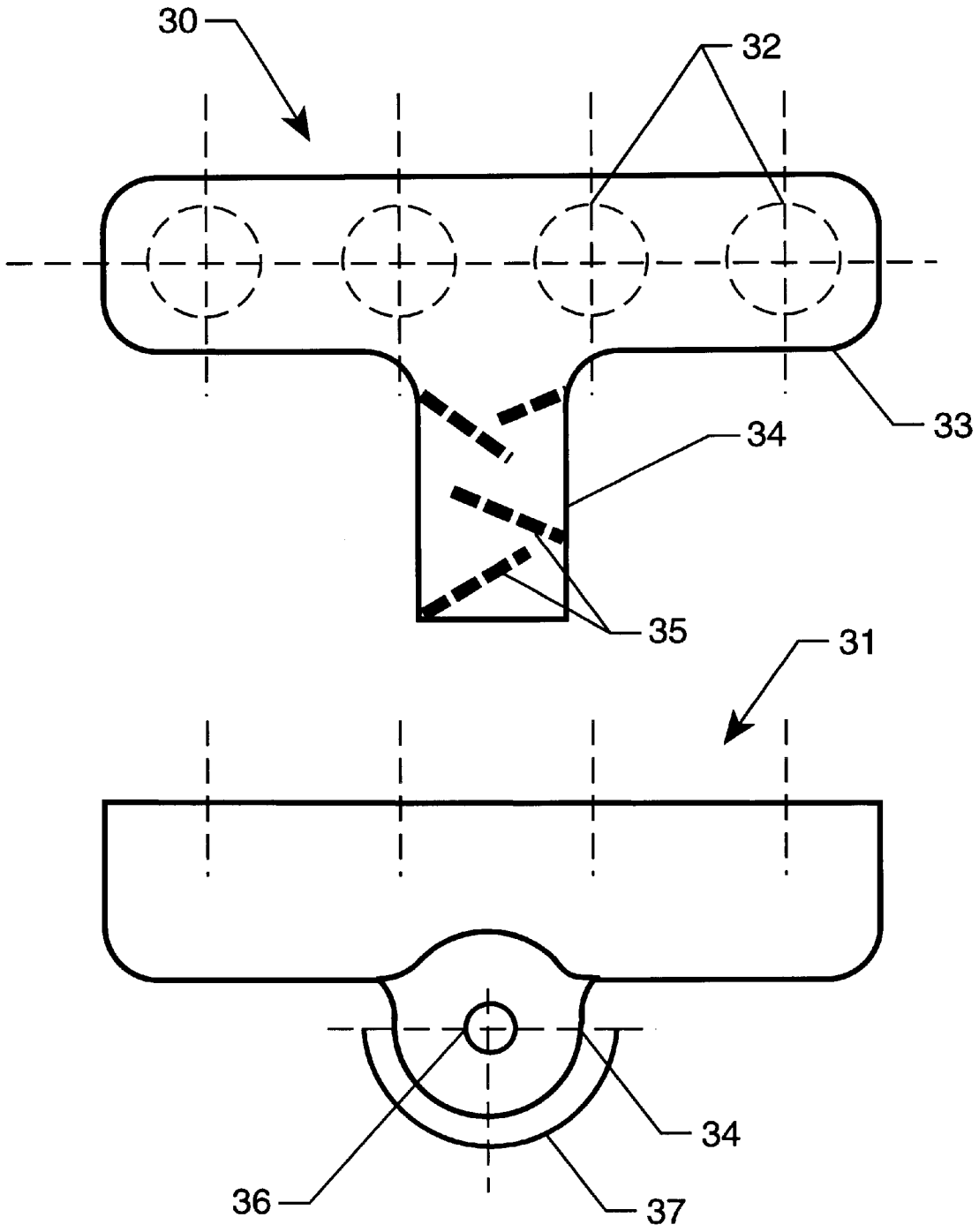
FIG. 3 is an illustration of an engine exhaust manifold with a thermal reactor, according to the present invention.

FIG. 3 depicts a side 30 and plan view 31 of a further improvement to an engine exhaust system according to the present invention with the exhaust-gas manifold 33 and exhaust pipe 34 fabricated from carbon-carbon-composite materials. The further improvement consists of a thermal reactor, which includes a plurality of mixers 35, a secondary air inlet 36, and a radiation shield 37. This thermal reactor replaces or augments the catalytic converter. The mixers 35 consist of a series of baffle plates which slow down the fuel-rich exhaust gases in the exhaust-gas manifold 33 and exhaust pipe 34. A secondary air inlet 36 injects fresh, ambient air into the exhaust-gas manifold 33 and exhaust pipe 34. The ambient air mixes with the fuel rich exhaust gas at high temperature, which is maintained due to the low thermal conductivity of carbon-carbon composite materials. The introduced air and high heat convert hydrocarbons and carbon monoxide, i.e. pollutants, in the fuel-rich exhaust gas into carbon dioxide and water, i.e. non-pollutants. As the heat generated during this thermal reaction is intense, a radiation shield 37 encircles the exposed half of the exhaust pipe 34. Radiation shield 37 is also fabricated from carbon-carbon composite materials to reduce weight and avoid heat loss.

The invention can be practiced in other manners than are described herein without departing from the spirit and the scope of the appended claims.

What is claimed is:

1. In an exhaust system for an internal combustion engine wherein a mixture of fuel and air is burned to form combustion products, the exhaust system including a plurality of engine exhaust ports which are connected to an engine exhaust manifold, which engine exhaust manifold causes exhaust gases to be expelled through a single, common exhaust pipe; the improvement comprising an engine exhaust manifold which has been fabricated substantially from carbon-carbon composite materials, said exhaust manifold being in operative association with an exhaust pipe which has been fabricated substantially from carbon-carbon composite materials.

2. The exhaust system of claim 1, wherein the carbon-carbon composite materials are coated with a sealant, to provide protection from oxidation and excessive wear.

3. The exhaust system of claim 2, wherein the sealant is a ceramic coating.

4. The exhaust system of claim 2, wherein the sealant is a metallic coating.

5. The exhaust system of claim 1, wherein the exhaust pipe includes thermal reactor to convert pollutants into non-pollutants.

6. The exhaust system of claim 5, wherein the thermal reactor comprises:

a plurality of baffle plates located within the exhaust gas manifold and exhaust pipe and configured and positioned so that mixing of exhaust gases and ambient air is effected within the exhaust manifold and exhaust pipe;

a secondary air inlet provided in the exhaust gas manifold for injecting fresh, ambient air into the exhaust manifold and exhaust pipe for mixing with the exhaust gases; and a radiation shield surrounding any outer surface of the exhaust pipe which is exposed to the air.

7. The exhaust system of claim 6, wherein the plurality of baffle plates is coated with a sealant to protect against oxidation and excessive wear.

8. The exhaust system of claim 7, wherein the sealant is a ceramic coating.

9. The exhaust system of claim 7, wherein the sealant is a metallic coating.

10. The exhaust system of claim 6, wherein the radiation shield is fabricated from carbon-carbon composite materials.

11. In an exhaust system for an internal combustion engine wherein a mixture of fuel and air is burned to form combustion products, the exhaust system including a plurality of engine exhaust ports which are connected to an engine exhaust manifold, which engine exhaust manifold causes exhaust gases to be expelled through a single, common exhaust pipe; the improvement comprising an engine exhaust manifold which has been fabricated from carbon-carbon composite materials, said exhaust manifold being in operative association with an exhaust pipe which has been fabricated from carbon-carbon composite materials, wherein the exhaust pipe includes a thermal reactor for converting pollutants to non-pollutants, the thermal reactor comprising:

a plurality of baffle plates located within the exhaust gas manifold and exhaust pipe and configured and positioned so that mixing of exhaust gases and ambient air is effected within the exhaust gas manifold and exhaust pipe;

a secondary air inlet provided in the exhaust gas manifold for injecting fresh, ambient air into the exhaust gas manifold and exhaust pipe for mixing with the exhaust gases; and a radiation shield surrounding any outer surface of the exhaust pipe which is exposed to the air.

12. The exhaust system of claim 11, wherein the plurality of baffle plates is coated with a sealant to protect against oxidation and excessive wear.

13. The exhaust system of claim 12, wherein the sealant is a ceramic coating.

14. The exhaust system of claim 12, wherein the sealant is a metallic coating.

15. The exhaust system of claim 11, wherein the radiation shield is fabricated from carbon-carbon composite materials.

16. In an exhaust system for an internal combustion engine wherein a mixture of fuel and air is burned to form combustion products, the exhaust system including a plurality of engine exhaust ports which are connected to an engine exhaust manifold, which engine exhaust manifold causes exhaust gases to be expelled through a single, common exhaust pipe; the improvement comprising an engine exhaust manifold which has been fabricated substantially from carbon-carbon composite materials, said exhaust manifold being in operative association with an exhaust pipe which has been fabricated substantially from carbon-carbon composite materials, said exhaust manifold having a secondary air inlet for injecting fresh, ambient air into the exhaust manifold and exhaust pipe for mixing with the exhaust gases.

* * * * *